US012209518B1

(12) United States Patent
Burcar et al.

(10) Patent No.: US 12,209,518 B1
(45) Date of Patent: Jan. 28, 2025

(54) SPACER EQUIPPED TO SPRAY OIL FOR VALVETRAIN IN AN ENGINE SYSTEM

(71) Applicant: Caterpillar Inc., Peoria, IL (US)

(72) Inventors: Quinton Burcar, Chillicothe, IL (US); Jeffrey C. Krieger, Brimfield, IL (US); Paul K. Stark, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/610,631

(22) Filed: Mar. 20, 2024

(51) Int. Cl.
*F01M 9/10* (2006.01)
*F01L 1/18* (2006.01)

(52) U.S. Cl.
CPC ..... *F01M 9/10* (2013.01); *F01L 1/181* (2013.01); *F01M 9/105* (2013.01)

(58) Field of Classification Search
CPC ..... F01L 1/181; F01M 9/10; F01M 9/105
USPC ..... 123/90.36
See application file for complete search history.

(56) References Cited

U.S. PATENT DOCUMENTS

| | | | | |
|---|---|---|---|---|
| 4,401,064 | A * | 8/1983 | Nakamura | F01L 1/181 123/90.34 |
| 5,394,842 | A | 3/1995 | Suzuki | |
| 6,230,676 | B1 | 5/2001 | Pryba et al. | |
| 6,352,062 | B1 | 3/2002 | Ferrea | |
| 9,394,914 | B2 | 7/2016 | Kirk et al. | |
| 9,726,282 | B2 | 8/2017 | Pohl et al. | |

FOREIGN PATENT DOCUMENTS

| | | | |
|---|---|---|---|
| CN | 210239770 | U | 4/2020 |
| CN | 110700913 | B | 1/2022 |
| JP | 6508976 | B2 | 5/2019 |

* cited by examiner

*Primary Examiner* — Jorge L Leon, Jr.
(74) *Attorney, Agent, or Firm* — Brannon Sowers & Cracraft PC

(57) ABSTRACT

A spacer for a valvetrain in an engine system includes a spacer body defining a spacer axis and including a through-bore extending from a first axial end to a second axial end, an outer arcuate surface, and an inner arcuate surface having an oil feed inlet. The spacer further includes an orientation element extending from the spacer body and defining an orientation axis transverse to the spacer axis, and including an inner orientation surface and an outer orientation surface. The spacer further includes an oil application structure defining a structure axis oriented transverse to both the spacer axis and the orientation axis, and including a plurality of oil spray channels, each respective one of the plurality of oil spray channels including an oil outlet at a termination point and being fluidly connected to the oil feed inlet.

18 Claims, 7 Drawing Sheets

SPACER EQUIPPED TO SPRAY OIL FOR VALVETRAIN IN AN ENGINE SYSTEM

TECHNICAL FIELD

The present disclosure relates generally to an engine system, and more particularly to a spacer for a valvetrain equipped to spray oil.

BACKGROUND

Internal combustion engines typically include valve trains to control the opening and closing of intake and exhaust valves and sometimes actuate fuel injectors. In general terms, intake and exhaust valves regulate the flow of air and/or an air and fuel mixture and exhaust, respectively, into and out of a combustion cylinder. Over the course of an engine cycle, the valvetrain controls opening and closing of intake valves, permitting fresh air and/or an air and fuel mixture to enter into combustion cylinders, and opens and closes exhaust valves to remove combustion products. Where direct fuel injectors are used, the valvetrain may operate the fuel injectors for pressurization of a fuel to an injection pressure. In a typical configuration one or more rotatable camshafts are coupled to rocker arms that are pivoted upon a rocker shaft to actuate the subject engine valve and fuel injector components. The reliable operation of valvetrain components is crucial for timing of engine events to ensure optimal engine operation.

In recent years, engineers have been motivated to modify existing engine platforms to, for example, operate with reduced levels of certain emissions, take advantage of new and/or different fuels, or to operate in different applications. Natural gas and certain other gaseous fuels may be associated with perceived benefits such as reductions in certain emissions, notably particulate matter. The modifications may include adjustments to the fuel injection system, including variations in the parts and sometimes functions of the valvetrain components. Valvetrain apparatuses generally include numerous different components that must be mounted and operated in a relatively tight packaging space. The size and configuration of the packaging space can be altered as compared to an existing platform where components are added or removed. Other factors can also be affected including lubrication and/or cooling requirements.

One known lubricating spacer that is used in a valvetrain is set forth in U.S. Pat. No. 6,230,676 to Toledo Technologies Inc. In the Toledo patent, a spacer sleeve for a rocker arm is disclosed. A central mounting shaft is formed from a series of relatively short, hardened shafts connected together. The connection is apparently facilitated by the spacer sleeve to support the shaft segments. While the design set forth in the '676 patent may have certain applications, there is always room for improvements and/or development of alternative strategies.

SUMMARY

In one aspect, an engine system includes a rocker shaft defining a rocker shaft axis and including therein a lengthwise oil passage, a plurality of rocker arms upon the rocker shaft, and a spacer positioned upon the rocker shaft and adjacent one of the rocker arms. The spacer includes an outer arcuate surface, and an inner arcuate surface having therein an oil feed inlet. The spacer further includes an oil application structure coupled to the spacer and including an oil spray channel fluidly connected to the oil feed inlet and extending outwardly relative to the rocker shaft axis to an oil spray outlet. A transfer passage is formed at least in part in the spacer and fluidly connects the lengthwise oil passage to the oil spray channel.

In another aspect, a spacer for a valvetrain in an engine system includes a spacer body defining a spacer axis and including a through-bore extending from a first axial end to a second axial end, an outer arcuate surface, and an inner arcuate surface having an oil feed inlet. The spacer further includes an orientation element extending from the spacer body and defining an orientation axis transverse to the spacer axis, and including an inner orientation surface and an outer orientation surface. The spacer further includes an oil application structure defining a structure axis oriented transverse to both the spacer axis and the orientation axis, and including a plurality of oil spray channels, each respective one of the plurality of oil spray channels including an oil outlet at a termination point and being fluidly connected to the oil feed inlet.

In yet another aspect, a spacer for a valvetrain includes a spacer body defining a spacer axis and including a through-bore extending from a first axial end to a second axial end, an outer arcuate surface, and an inner arcuate surface having therein an oil feed inlet. The spacer further includes an outer orientation surface extending from the spacer body and defining an orientation axis oriented transverse to the spacer axis. The spacer further includes a plurality of oil spray channels, each respective one of the plurality of oil spray channels including an oil outlet at a termination point and being fluidly connected to the oil feed inlet. The spacer further includes a transfer passage formed, at least in part, in the inner arcuate surface and fluidly connected to the plurality of oil spray channels.

DETAILED DESCRIPTION

Figure 1:
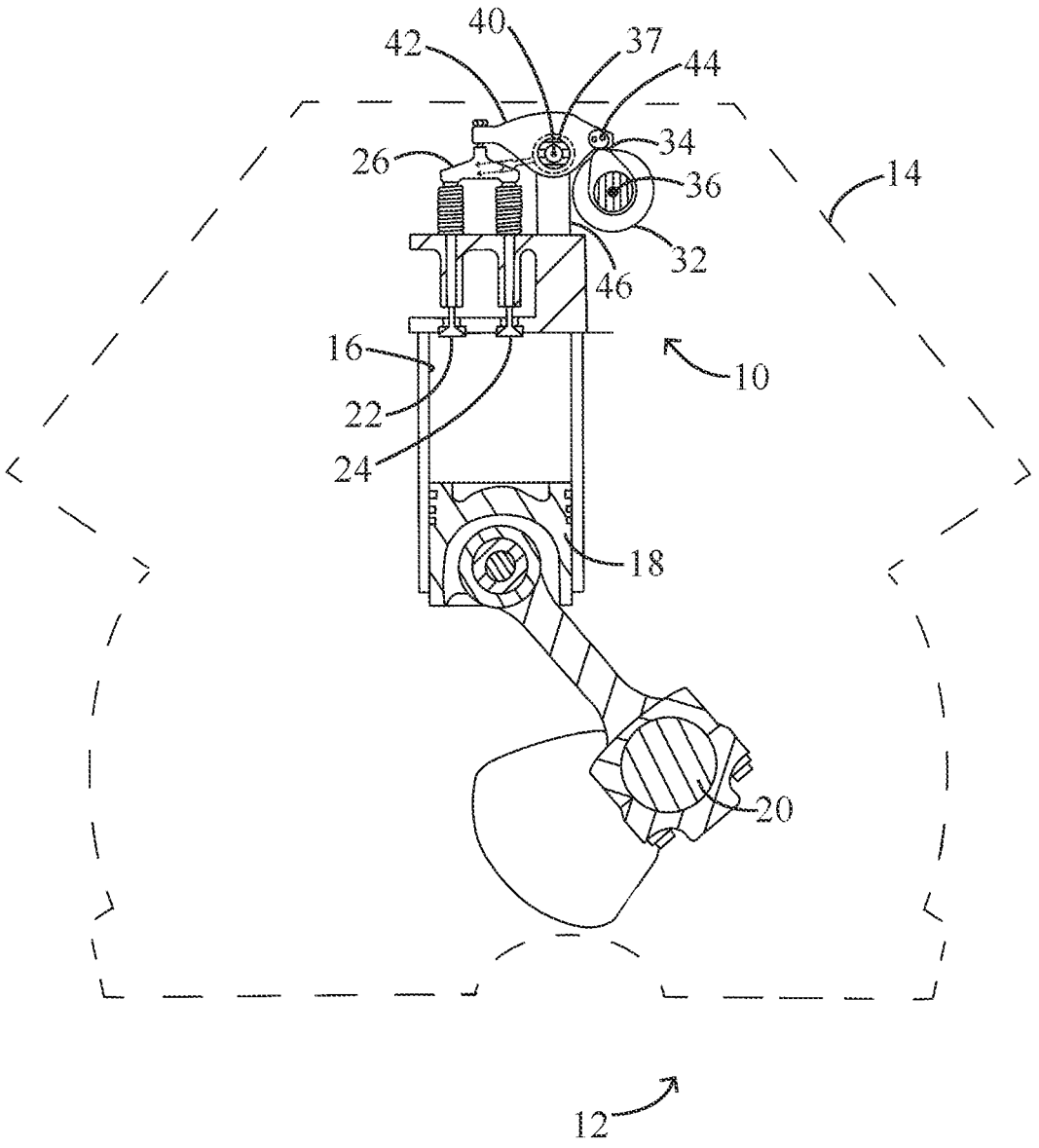
FIG. 1 is a partially sectioned diagrammatic view of an engine system, according to one embodiment.

Referring to FIG. 1, illustrated is a valvetrain 10 in an internal combustion engine 12. Internal combustion engine 12 includes an engine housing 14 having a cylinder 16 formed therein, and a piston 18 movable in cylinder 16. Engine 12 further includes a piston 18 coupled with a crankshaft 20 in a generally conventional manner. Engine 12 also includes a plurality of engine valves 22 and 24. Cylinder 16 may be associated with two intake valves and two exhaust valves, although the present disclosure is not strictly limited as such. As illustrated, engine valves 22 and 24 are coupled together by way of a valve bridge 26. Thus, it will be appreciated that FIG. 1 can be understood to illustrate two exhaust valves or two intake valves, and additional engine valves are not visible in the illustration. Valvetrain 10 is structured to open and close engine valves 22 and 24 together in response to rotation of a camshaft 32 about a camshaft axis 36. Cylinder 16 may be one of any number of cylinders arranged in engine 12 in any configuration such as a V-pattern, an inline pattern, or still another. Valvetrain 10 also includes a spacer equipped for spraying oil, the features and functionality of which are further discussed herein.

Figure 2:
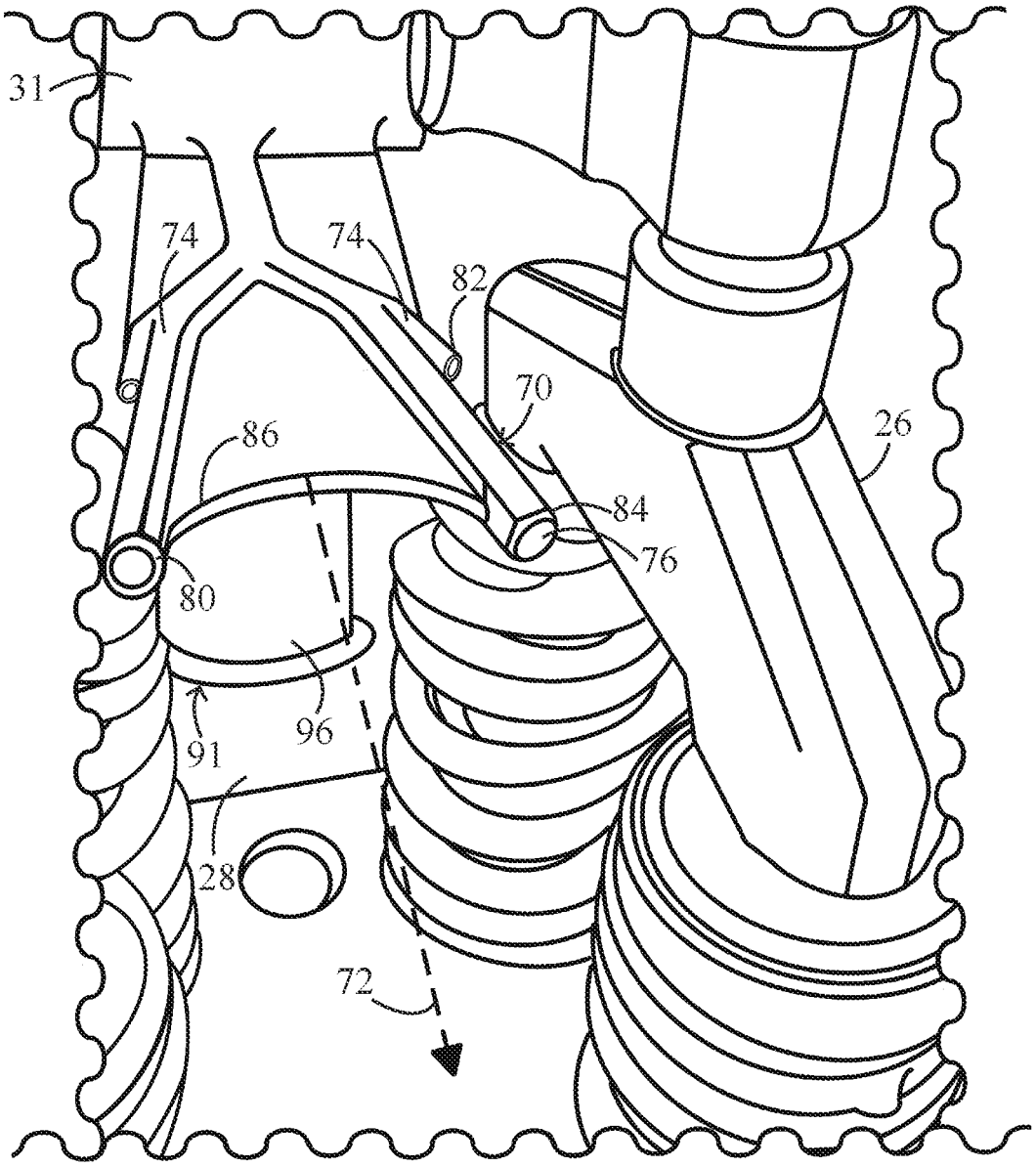
FIG. 2 is a perspective view of a valvetrain in an engine system, according to one embodiment.
Figure 3:
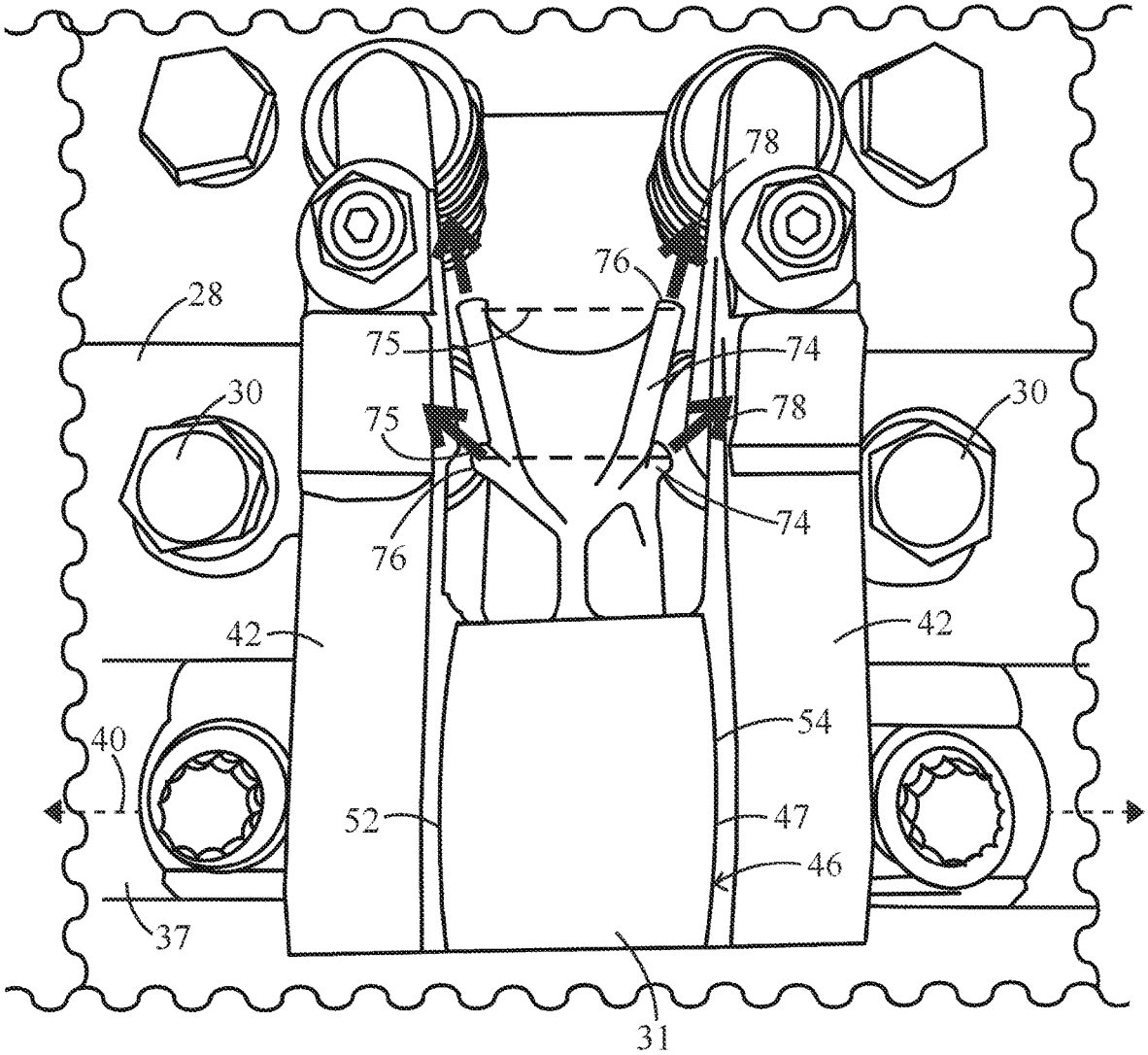
FIG. 3 is an overhead view of a valvetrain in an engine system, according to one embodiment.

Referring also now to FIGS. 2 and 3, there are shown additional features of valvetrain 10 mounted generally above and upon a cylinder head 28 of engine 12. Cylinder head 28 may be secured to a cylinder block by way of a plurality of head bolts 30. A spacer 31 may be structured to couple to one of the plurality of head bolts 30, as discussed further subsequently. Engine 12 also includes camshaft 32 having a plurality of cam lobes 34, rotatable with camshaft 32 about camshaft axis 36. Camshaft 32 may be rotated by way of an engine geartrain (not shown). Engine 12 also includes a rocker shaft 37 having therein a lengthwise oil passage illustrated and discussed subsequently, extending along a rocker shaft axis 40 to supply an oil such as engine oil for lubrication and cooling. The oil conveyed through rocker shaft 37, such as from the main engine oil system, provides lubrication and cooling to various components in engine 12, such as rocker arms 42, by guiding oil to desired locations for spraying upon engine components, including components in valvetrain 10.

Positioned upon rocker shaft 37 are a plurality of rocker arms 42 designed to pivotally move in response to the rotation of camshaft 32. A roller 44 may be supported in each rocker arm 42 and positioned adjacent camshaft 32 to directly contact one of cam lobes 34 as the respective cam lobe 34 rotates concurrently with camshaft 32. It should be understood within the context of the present disclosure that there may exist in valvetrain 10 a plurality of rocker arms 42, and potentially a plurality of spacers 31 as further discussed herein. The plurality of spacers 31 may each be positioned adjacent to at least one rocker arm 42, and potentially each positioned between two rockers arms 42 and may be arranged in a sequential alternating pattern with a plurality of rocker arms 42 upon rocker shaft 37.

Figure 4:
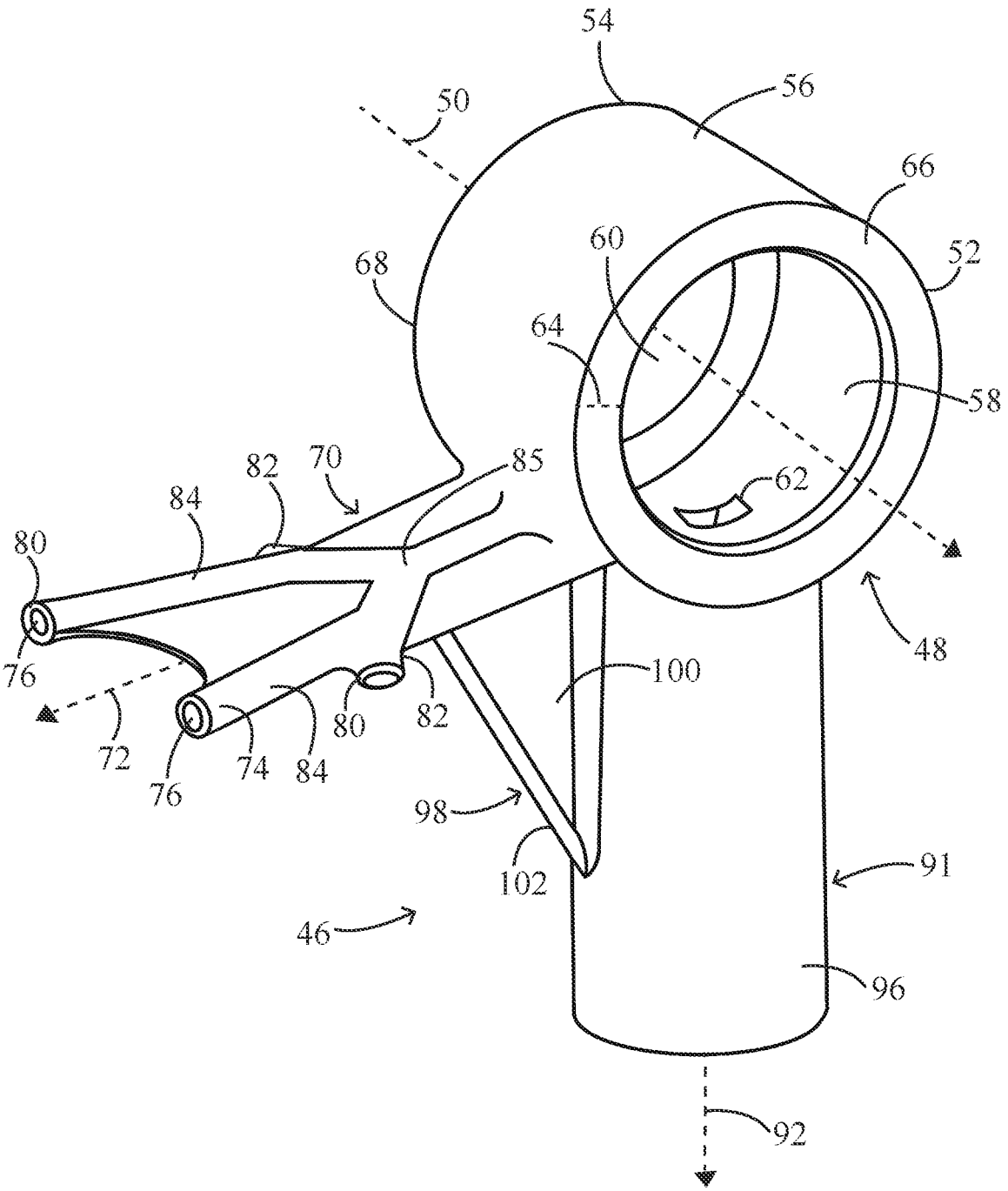
FIG. 4 is a perspective view of a spacer for a valvetrain, according to one embodiment.

Referring now also to FIG. 4, there are shown additional features and details of an example spacer 31. Spacer 31 may include a one-piece spacer body 46, formed by machining a casting or a forging, for example, or a part produced by additive manufacturing. One-piece spacer body 46 may be formed from a suitable metallic material, such as an iron or a steel. In some embodiments, spacer 31 could be formed by attaching multiple separate pieces such as by welding, brazing, etc. Hereafter, the terms "spacer" and "spacer body" are used, at times, interchangeably.

Spacer 31 may include a first section 48 defining a spacer axis 50 extending between a first axial end 52 and a second axial end 54. First section 48 may include an outer arcuate surface 56, and an inner arcuate surface 58 forming a through-bore 60 and having therein an oil feed inlet 62 to receive a feed of oil supplied through rocker shaft 37. Rocker shaft 37 extends through through-bore 60 when spacer 31 is installed in valvetrain 10 for service establishing a fluid connection between the lengthwise oil passage and oil feed inlet 62. A radial distance between outer arcuate surface 56 and inner arcuate surface 58 is shown at numeral 64. Outer arcuate surface 56 and inner arcuate surface 58 may further extend to a first axial end surface 66 and a second axial end surface 68. Both first axial end surface 66 and second axial end surface 68 could be planar and oriented perpendicular relative to spacer axis 50.

As suggested above, valvetrain 10 is configured for supplying oil for lubrication and cooling. To this end, spacer 31 may include an oil application structure 70 defining a structure axis 72 oriented transverse to rocker shaft axis 40 and spacer axis 50. Oil application structure 70 may further include a plurality of oil spray channels 74, each fluidly connected to oil feed inlet 62 and extending through oil application structure 70, projecting from spacer 31. As shown in FIG. 3, each respective oil spray channel 74 may include a termination point shown approximately at numeral 75 wherein each oil spray channel 74 forms an oil outlet 76. Termination point 75, as herein defined, refers to the location where each oil spray channel 74 terminates, from which an oil spray jet propagates. Oil spray channels 74 may be oriented so as to advance radially outward of spacer axis 50, and are designed to emit an oil spray (arrows 78) onto surfaces of various parts of valvetrain 10. Additionally or alternatively, oil spray channels 74 may be divergent from one another as oil spray channels 74 advance radially outwardly relative to spacer axis 50. Oil spray channels 74 may each further be formed by oil spray channel surfaces 80 extending around the fluid conduit forming each respective oil spray channel 74. In some embodiments, parts or all of oil spray application structure 70 could be formed as separate parts that are inserted into spacer body 46. Individual hollow conduits could be inserted to form each respective oil spray channel, potentially enabling customization to provide an oil spray pattern targeted for cooling and lubrication in a given engine system. It should be understood that a variety of configurations may be applicable to either oil spray channels 74 and/or oil spray channel surfaces 80, including but not limited to instances where the oil spray channels may have a variety of lengths, diameters, outlet shapes, or other features discussed further herein.

In an embodiment, some of oil spray channels 74 may be truncated, signifying a shortened length relative to at least one other oil spray channel 74, and/or may be extended, denoting an elongated length relative to at least one other oil spray channel 74. In the context of the present disclosure, spacer 31 includes a plurality of truncated oil spray channels 82, and a plurality of extended oil spray channels 84. Oil spray channels (collectively "oil spray channels 74") may also form a bifurcation 85, including a fork or split pattern, designed to separate the flow of oil into distinct paths and orient oil spray streams in different directions to spray onto various parts of valvetrain 10. Oil application structure 70 may further include a bridging wall 86 structured to connect at least two extended oil spray channels 84. Bridging wall 86 may extend in a direction generally across to structure axis 72 and is structured to provide stability for channels that extend outwardly and away from spacer body 46. As can be seen in FIG. 3, bridging wall 86 is positioned closer to termination points 75 than to spacer body 46, although variations to bridging wall 86 position, shape, orientation, may be implemented such that bridging wall 86 is closer to spacer body 46, or positioned equidistant to termination points 75 and spacer body 46. Still other embodiments might not include a bridging wall at all.

As suggested above, oil spray channels within the present disclosure may vary in number and/or arrangement contingent upon desired lubrication and/or cooling locations. For example, at least one of oil spray channels 74 may be truncated and/or one may be extended relative to another oil spray channel 74. In a refinement, two of a plurality of oil spray channels 74 may be truncated and/or two oil spray channels 74 may be extended. In other examples, oil spray channels 74 may include a finite number of oil spray channels 74, such as a number greater than three, defining among them a plurality of different oil spray trajectories. Emitting oil spray 78 in different oil spray trajectories enables oil to be directed toward valve springs, valve stems, or other engine components which require lubrication and/or cooling. One or more oil spray trajectories might extend more downwardly, some more directly outwardly, and others even upwardly in some applications. A regular geometric pattern or a non-regular geometric pattern might be defined by the several oil spray trajectories. While FIG. 3 illustrates oil spray in certain directions, it should be appreciated the illustration serves as an illustrative example, and the precise configuration may vary among engines depending on lubrication and/or cooling requirements.

Figure 5:
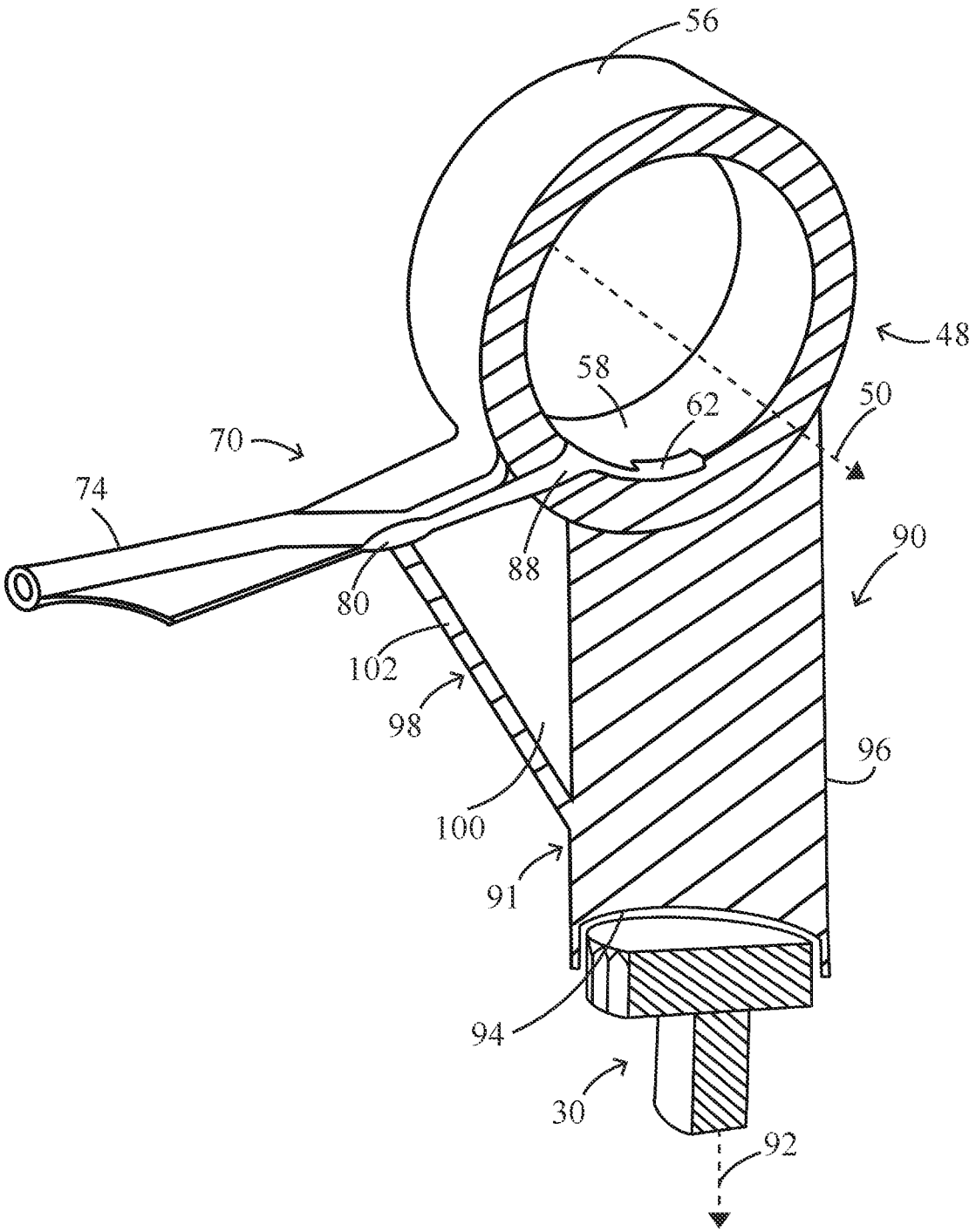
FIG. 5 is a sectioned view, in perspective, of a spacer and a head bolt in alignment, according to one embodiment.

Referring also now to FIG. 5, spacer 31 may further include a transfer passage 88 circumferentially extending to oil application structure 70, and adapted to fluidly connect lengthwise oil passage 38 to oil spray channels 74. Transfer passage 88 may be formed at least in part in inner arcuate surface 58. Transfer passage 88 can be formed as an open channel defined between rocker shaft 37 and inner arcuate surface 58. In other instances, transfer passage 88 could be a closed channel formed in spacer body 46, or some combination of an open channel and a closed channel. The fluid connection established by transfer passage 88 facilitates movement of oil from rocker shaft 37 to oil spray channels 74. An orientation and/or a circumferential length of transfer passage 88 may be contingent upon the placement of oil spray channels 74 relative to transfer passage 88 which extends from lengthwise oil passage 38. For example, transfer passage 88 may extend less than 360° around spacer axis 50 in one embodiment, and in a refinement transfer passage may extend less than 180°. In one practical implementation, transfer passage 88 could extend less than 120°, and potentially may extend approximately 90° or less. "Approximately," "generally," "about," or other relative terms used herein can be understood to mean within measurement error or within some other tolerance that would be applied by a person of ordinary skill in the art. While the present description discusses transfer passage 88 being formed at least in part within the inner arcuate surface 58 of spacer 31, it may be appreciated that transfer passage 88 could have a variety of forms, including placement of transfer passage 88 in rocker shaft 37, or in part in spacer 31 and in part in rocker shaft 37. Spacer 31 and/or rocker shaft 37 might be equipped with multiple transfer passages 88 in some embodiments and/or transfer passages 88 that advance in not only a circumferential direction but also an axial direction.

Spacer 31 may further include a second section 90 coupled to first section 48. Second section 90 may couple spacer 31 to head bolt 30 and defines an orientation axis 92 transverse to structure axis 72. As illustrated, outer arcuate surface 56 and inner arcuate surface 58 form a horizontal cylindrical pattern, characterized by a continuous curvature around spacer axis 50, relative to the normal arrangement of orientation axis 92, which is perpendicular. Oil application structure 70 may be positioned angularly from second section 90 circumferentially around spacer axis 50. Second section 90 may further include an orientation element 91 that locates spacer 31 for service. Orientation element 91 may extend from first section 48 toward cylinder head 28, and may be matingly received upon head bolt 30, providing alignment upon rocker shaft 37 and an upright positioning of first section 48. Orientation element 91 may include an inner orientation surface 94 and an outer orientation surface 96, or alternatively, solely outer orientation surface 96, provided that spacer 31 is structured to be matingly received upon head bolt 30.

Also in the illustrated embodiment, spacer 31 includes a spacer supporting wall or brace 98 connecting between orientation element 91 and oil application structure 70, designed to support oil application structure 70. To elaborate further, spacer brace 98 may diagonally extend from outer orientation surface 96 to oil spray channels 74 and/or other parts of oil application structure 70. Spacer brace 98 may include a first brace surface 100 and a second brace surface 102 each of which is generally triangular.

Figure 6:
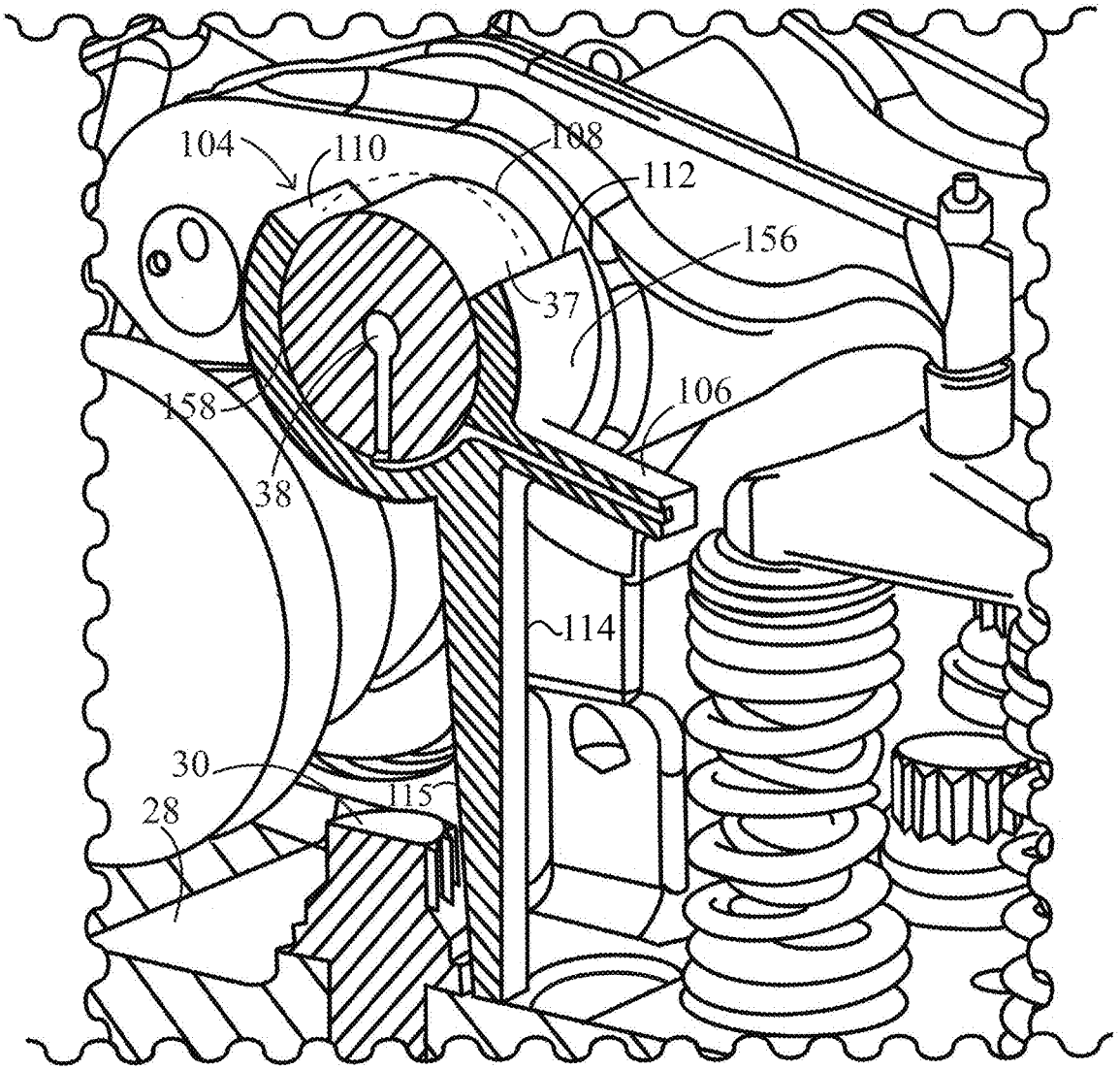
FIG. 6 is a sectioned view, in perspective, of a spacer in a valvetrain, according to one embodiment.

Referring now to FIG. 6, there is shown a spacer 104 according to another embodiment. In FIG. 4 certain reference numerals are used to identify features similar or identical to those of other illustrated embodiments. Spacer 104 may be structured and functions in many ways similarly to spacer 31 discussed above, and the foregoing description of spacer 31 should be understood to refer to spacer 104 except where otherwise indicated or apparent from the context. Spacer 104 may include a total of one oil spray channel 106, as illustrated in FIG. 6. Spacer 106 may additionally include a partial circular shape extending less than a full revolution around the rocker shaft 37. Due to spacer 104 extending less than a full revolution around rocker shaft 37, an axially extending opening 108 is formed which spans along both an inner arcuate surface 158 and an outer arcuate surface 156, defining planar surfaces. The planar surfaces, namely a first planar surface 110 and second planar surface 112, are positioned where spacer 104 does not fully extend around rocker shaft axis 40.

Another distinction of spacer 104 is the design of an orientation element 114. As illustrated, spacer 104 may also include an elongate orientation element 114 which may be tapered and extend toward cylinder head 28. Orientation element 114 may include at least one engagement surface 115, structured for contact with head bolt 30 and/or cylinder head 28, positioning spacer 104 for service in valvetrain 10.

Figure 7:
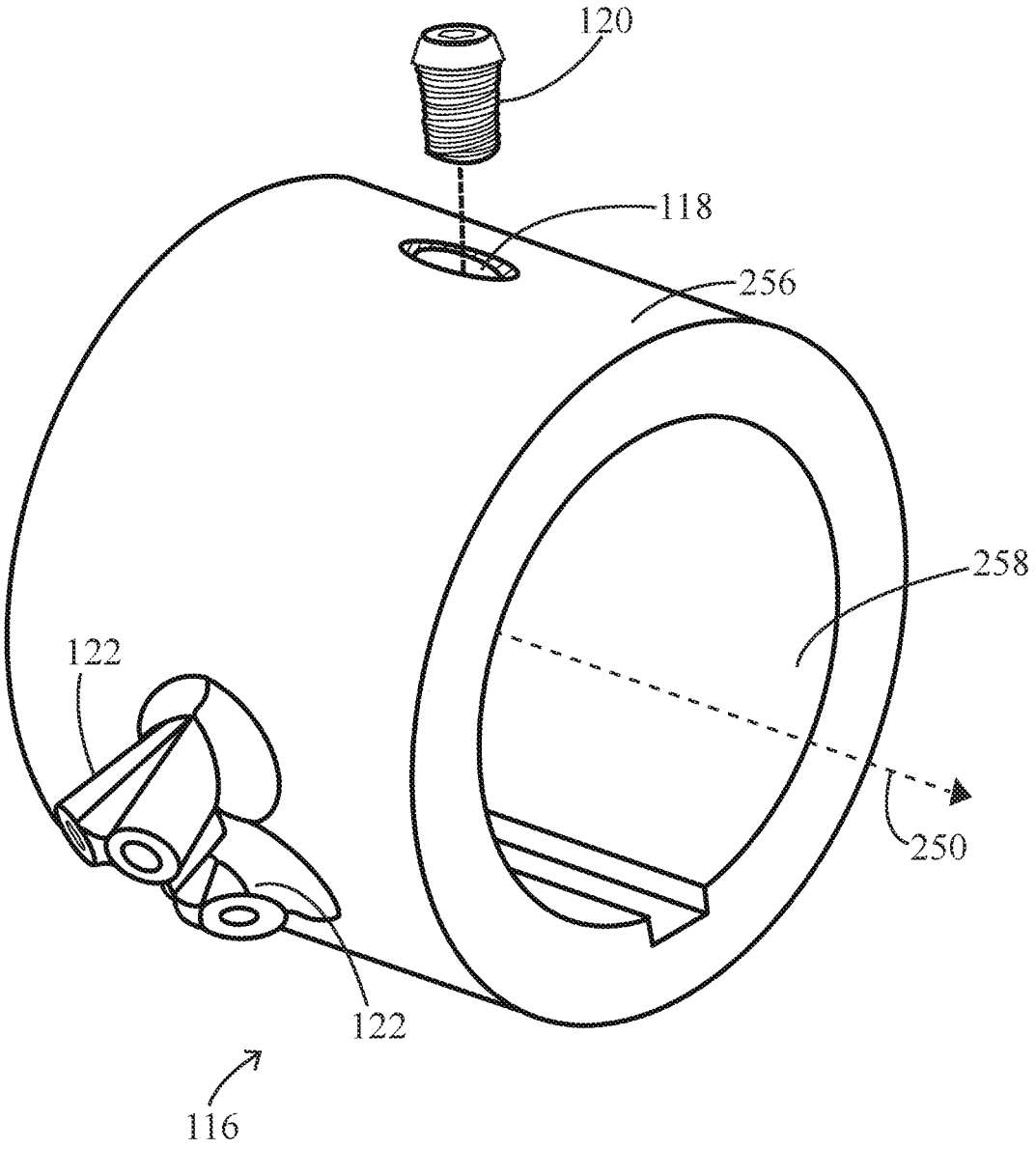
FIG. 7 is an exploded view, in perspective, of a spacer and head bolt for a valvetrain, according to another embodiment.

Referring now to FIG. 7, there is shown yet another spacer 116 according to another embodiment. In contrast to certain other embodiments herein, spacer 116 may lack a separate, extending orientation element. In spacer 116, a fastener bore 118 may extend axially between an outer arcuate surface 256 and an inner arcuate surface 258. Spacer 116 may also include a set screw 120 structured to be threadedly received in fastener bore 118. When spacer 116 is installed in a valvetrain for service, set screw 120 is axially disposed within fastener bore 118 and in contact with a rocker shaft, affixing spacer 116 upon the rocker shaft. Another distinctive feature of spacer 116 is the inclusion of a plurality of similar-length oil spray channels 122 that may be mutually divergent both vertically and horizontally. It should also be appreciated that oil spray channels 122 are spaced circumferentially relative to spacer axis 250. As suggested above, there is potential variability with oil spray channel length, and in this instance, a truncated configuration is utilized.

INDUSTRIAL APPLICABILITY

As explained above, certain engine platforms, including existing engines removed from service in the field or newly built engines that were previously designed for operation on one fuel type, can be modified for operation on a different fuel type. One example includes modifications to an existing diesel engine platform to operate on natural gas or another gaseous fuel, such as hydrogen or various gaseous fuel blends. Adjustments for such a modification can include the removal of valvetrain components previously used to actuate a diesel fuel injector, including a dedicated injector rocker arm, rendering packaging space available that was previously occupied by a fuel injector and rocker arm. Moreover, any such modification to an engine, and notably transitioning from diesel to gaseous fuel, can alter the cooling and lubrication requirements.

Referring to the drawings generally, but focusing on the embodiment of FIGS. 1-5, during operation of engine 12, combustion of a mixture of air and fuel causes engine 12 to generate heat. In the case of gaseous fuel engines, cooling and lubrication requirements may be greater than in the case of diesel engines given that the fuel itself has little, if any, contribution to such purposes. In a practical implementation, valvetrain 10 may include a plurality of spacers 31 positioned upon rocker shaft 37 and between two rocker arms 42. Spacers 31 can assist in maintaining spacing between components in valvetrain 10, occupying available space that would have been taken up by a rocker arm 42 for a fuel injector in a prior system, and also providing a conduit for spraying engine oil pumped through valvetrain 10 onto various components. In the course of operation, oil is pressurized and circulated and exchanges heat with metal surfaces of engine 12, and carries away the heat to be dissipated while simultaneously ensuring the moving parts of the engine 12 remain lubricated. In the illustrated embodiment, pressurized oil travels through rocker shaft 37 and is sprayed out of each respective spacer 31 via oil spray channels 74, lubricating and cooling components within valvetrain 10, including valve springs, valve stems, etc. Valvetrain 10 or components thereof such as spacer 31 can be sold, for example, as original equipment on a newly built engine 12 or provided as aftermarket equipment for replacement or modification of a valvetrain in an existing engine system.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having." or the like are intended to be open-ended terms. Further, the phrase "based on" is intended to mean "based, at least in part, on" unless explicitly stated otherwise.

What is claimed is:

1. An engine system comprising:

a rocker shaft defining an axially extending oil supply passage;

a plurality of rocker arms mounted to the rocker shaft;

a spacer mounted to the rocker shaft at a position adjacent to a first rocker arm of the plurality of rocker arms, the spacer including:

a cylindrical outer surface, a cylindrical inner surface configured to receive the rocker shaft, and an oil feed inlet defined in the inner surface so as to be fluidly connected to the oil supply passage; and an oil application structure extending outwardly from the outer surface, the oil application structure including an oil spray channel fluidly connected to the oil feed inlet via a transfer passage at least partially formed in the spacer.

2. The engine system of claim 1 wherein the spacer is a first spacer of a plurality of spacers respectively arranged between adjacent rocker arms of the plurality of rocker arms upon.

3. The engine system of claim 1 wherein the oil spray channel is a first oil spray channel of a plurality of oil spray channels of the oil application structure.

4. The engine system of claim 1 wherein the spacer further includes a fastener bore extending from the outer surface to the inner surface, the fastener bore configured to receive a set screw which fastens the spacer to the rocker shaft.

5. The engine system of claim 1 further comprising a cylinder head including a head bolt, wherein the spacer further includes an orientation element which engages at least one of the cylinder head or the head bolt.

6. The engine system of claim 5 wherein the orientation element mates with the head bolt.

7. A spacer for a valvetrain in an engine system, the spacer comprising:

a spacer body including:

a first axial end, a second axial end, a cylindrical outer surface, a cylindrical inner surface defining a through-bore extending from the first axial end to the second axial end along a spacer axis, and an oil feed inlet defined in the inner surface;

an orientation element extending outwardly from the outer surface along an orientation axis which is transverse to the spacer axis, the orientation element including an inner orientation surface and an outer orientation surface; and an oil application structure extending outwardly from the outer surface along a structure axis which is transverse to the spacer axis and the orientation axis, the oil application structure including a plurality of oil spray channels each terminating at a respective oil spray outlet fluidly connected to the oil feed inlet.

8. The spacer of claim 7 wherein the oil application structure is circumferentially spaced from the orientation element about the outer surface.

9. The spacer of claim 7 further comprising a spacer brace connecting the oil application structure to the orientation element.

10. The spacer of claim 7 wherein each oil spray channel extends in a respective direction radially outward of the outer surface.

11. The spacer of claim 7 wherein the plurality of oil spray channels forms a fork pattern.

12. The spacer of claim 7 wherein a first oil spray channel of the plurality of oil spray channels is truncated relative to a second oil spray channel of the plurality of oil spray channels.

13. A spacer for a valvetrain, the spacer comprising:

a spacer body including:

a first axial end, a second axial end, a cylindrical outer surface, a cylindrical inner surface defining a through-bore extending from the first axial end to the second axial end along a spacer axis, and an oil feed inlet defined in the inner surface;

an outer orientation surface extending outwardly from the outer surface along an orientation axis which is transverse to the spacer axis; and a plurality of oil spray channels each terminating at a respective oil spray outlet fluidly connected to the oil feed inlet via a transfer passage at least partially formed in the inner surface.

14. The spacer of claim 13 wherein each oil spray channel extends in a respective direction radially outward of the outer surface.

15. The spacer of claim 13 wherein the plurality of oil spray channels extends through an oil application structure projecting outwardly from the outer surface.

16. The spacer of claim 15 wherein each oil spray channel respectively defines a different oil spray trajectory.

17. The spacer of claim 15 wherein the plurality of oil spray channels includes two truncated oil spray channels and two extended oil spray channels.

18. The spacer of claim 17 wherein the oil application structure includes a bridging wall extending between the two extended oil spray channels.

* * * * *